US005845811A

United States Patent [19]

Shervington et al.

[11] Patent Number: 5,845,811

[45] Date of Patent: Dec. 8, 1998

[54] GAS CAPSULE

[75] Inventors: Evelyn A. Shervington, Nr. Petersfield; David W. Birch, Bordon, both of England

[73] Assignee: The BOC Group Plc, Windlesham, England

[21] Appl. No.: 686,300

[22] Filed: Jul. 25, 1996

[30] Foreign Application Priority Data

Aug. 2, 1995 [GB] United Kingdom ..... 9515846

[51] Int. Cl.[6] ..... B67D 5/00

[52] U.S. Cl. ..... 222/3; 222/153.07; 222/153.06; 222/541.3; 222/541.6; 222/541.9; 604/70; 604/200; 215/49; 215/253; 220/266

[58] Field of Search ..... 604/68, 70, 200; 215/47, 48, 49, 250, 253, 255; 220/265, 266, 269; 206/222, 363, 364; 222/3, 4, 153.07, 153.06, 637, 541.3, 541.6, 541.9

[56] References Cited

U.S. PATENT DOCUMENTS

| | | | |
|---|---|---|---|
| 2,157,646 | 5/1939 | Barker | 222/541.9 X |
| 4,576,304 | 3/1986 | Henning | 220/269 |
| 4,913,699 | 4/1990 | Parsons | 604/68 |

FOREIGN PATENT DOCUMENTS

| | | |
|---|---|---|
| 0027340 | 4/1981 | European Pat. Off. . |
| 0080775 | 8/1983 | European Pat. Off. . |
| 0253744 | 6/1926 | United Kingdom . |
| 1583682 | 1/1981 | United Kingdom . |
| 2085836 | 5/1982 | United Kingdom . |
| 94/24263 | 10/1994 | WIPO . |

*Primary Examiner*—Kenneth Bomberg
*Attorney, Agent, or Firm*—David A. Draegert; Salvatore P. Pace

[57] ABSTRACT

A capsule for storing a propellant fluid, for example, helium under pressure comprises a hollow body which includes a frangible area. An anchor member attaches an arm to the frangible area such that when a force is applied to the arm, said force together with the helium under pressure will cause the frangible area to rupture outwardly of the hollow body thereby to release the helium.

5 Claims, 1 Drawing Sheet

GAS CAPSULE

The present invention relates to capsules for containing a volume of fluid at high pressure, that is, between 60 and 80 bar.

BACKGROUND OF THE INVENTION

The use of sealed capsules is well known in circumstances where the force of the fluid under pressure is employed to dispense a substance such as discharging draught beer from a beer dispenser or expelling soda water from a soda siphon. They can also be used for liquid containers for soft drinks or beer under pressure.

It is also known to employ sealed capsules containing helium at high pressures in the order of 30–40 bar in medical devices using the energy of the pressurised helium to drive a therapeutic agent through the skin of a patient.

In PCT published application WO94/24263 there is described a needleless syringe, which includes a metal capsule containing helium gas at high pressure which is used to force particles of a therapeutic agent through the skin of a patient in a substantially painless manner. The capsule is detachable from the remainder of the syringe and once used, either a new charge of gas can be placed in the capsule or more favourably the capsule can be discarded and a new capsule charged with gas can be attached to the remainder of the syringe.

In the circumstance where the gas capsule is a throw away item, it is important that it can be manufactured simply and cheaply. In medical applications helium gas is a favoured fluid since it is very light which makes it suitable for use as a propellant for therapeutic agents in that when it impinges against the skin of a patient it will bounce off into the atmosphere and not pass through the skin of the patient. However, helium because it is light, is difficult to contain since it will leak through the most minuscule fault in a container.

When the fluid pressure in the container is high the force required to break open the seal is often too high for normal "finger pressure" which is a particular requirement for medical applications.

In accordance with the present invention, there is provided a capsule for fluid under high pressure which can be manufactured simply and cheaply and can be opened simply by pressing a lever on the outside of the capsule. The capsules of the invention are further advantageous in that they can contain a fluid under pressure for example, helium gas, yet are substantially leak-proof and can be easily opened by pressure from a normal adult finger (2 kg).

SUMMARY OF THE INVENTION

According to the present invention, a capsule for storing a fluid at a pressure of at least 60 bar comprises a hollow body, the hollow body including a frangible area, means for fixedly attaching an arm to the frangible area such that the arm is spaced from and extends outwardly of the hollow body, the arrangement being such that a predetermined force applied to the arm in the direction of the hollow body will, together with the fluid pressure, cause the frangible area to rupture outwardly with the subsequent release of the fluid.

DETAILED DESCRIPTION OF THE PREFERRED EMBODIMENT

Figure 1:
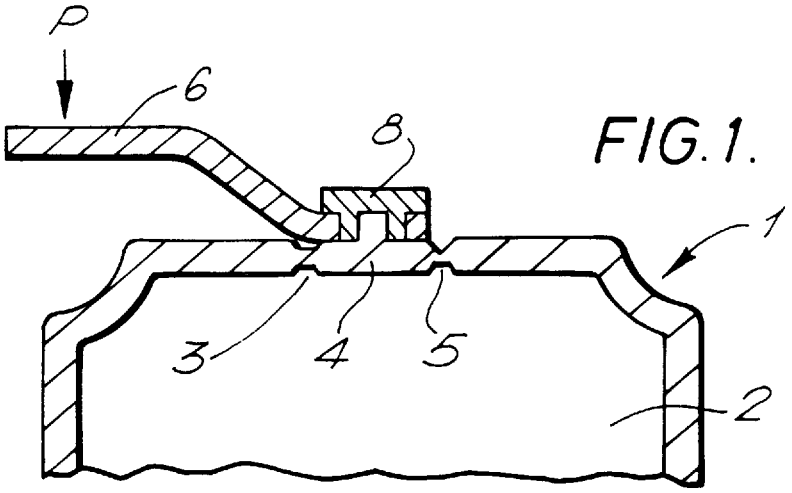
FIG. 1 is a partial side view partly in cross-section of a first capsule for storing a fluid under pressure.
Figure 2:
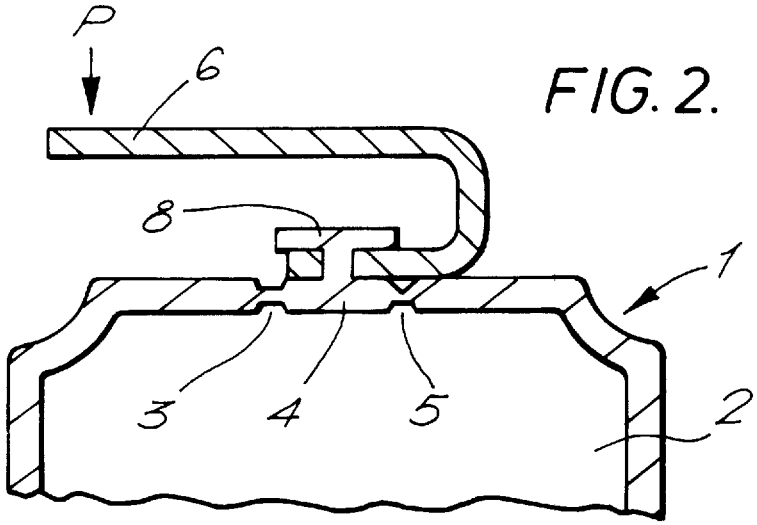
FIG. 2 is a view similar to FIG. 1 but illustrating a different arrangement of the arm for opening the capsule.

Referring first to FIGS. 1 and 2, a sealed metal capsule 1 comprises a substantially cylindrical hollow body 2 for containing a fluid e.g. helium gas, under high pressures in the order of 60–80 bar. The hollow body 2 is provided at its upper (as shown ) end with a frangible area 4. The frangible area 4 is formed by reducing the wall thickness at the upper end of the hollow body 2 over a portion of said end. An arm 6 is fixedly mounted to the outer surface of the frangible area 4 by means of an anchor member 8.

The frangible area 4 is defined at least in part by a weakened portion 3 which acts as a 'hinge' and a further portion 5 even more weakened where fracture commences as will be explained.

As shown in both FIGS., the arm is preferably mounted in cantilever fashion spaced from and extending outwardly from the upper end of the body 2 and the load is applied at or adjacent the free end of the arm in a direction towards the hollow body In use, when the energy of the fluid contained within the hollow body 2 is to be employed to dispense a substance or force particles of a therapeutic agent through the skin of a patient, then a force 'P' is applied at or adjacent the free end of the arm 6 which will cause the frangible area 4 to fracture initially at the portion 5, the portion 3 acting as a hinge. The fluid under pressure is thereby released from the hollow body 2 of the capsule 1.

It should be noted that in the above described embodiments, the energy of the fluid e.g. helium gas under pressure assists in the rupturing process in that it provides a force tending to lift the frangible area 4 from the remainder of the upper end of the hollow body 2.

It will be appreciated that the capsules described with reference to FIGS. 1 and 2 are relatively inexpensive to manufacture and furthermore are relatively leak-proof.

Figure 3:
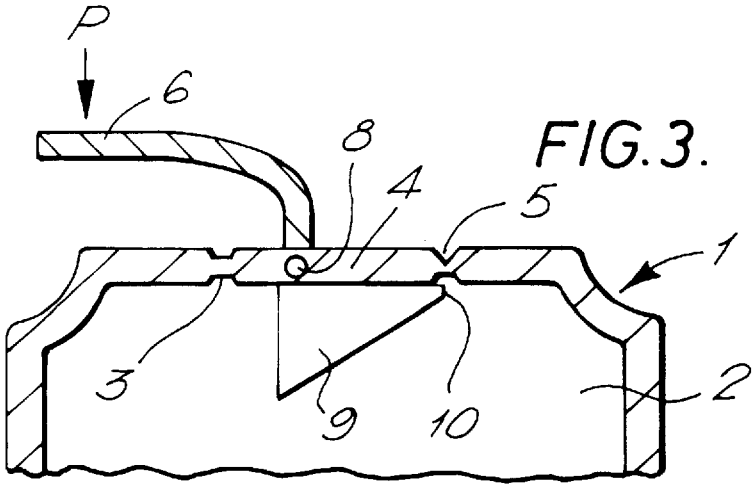
FIG. 3 is a view similar to FIG. 1 but illustrating a different embodiment of a sealed capsule for storing a fluid under pressure.

FIG. 3 illustrates an alternative embodiment wherein the arm can be mounted for pivoted movement on the frangible area and may include a foot part located inside the hollow body having an edge for engaging a portion of the frangible area. Referring to FIG. 3, where like reference numerals denote like parts, the cylindrical hollow body 2 is provided at its upper (as shown) end with a frangible area 4. The frangible area 4 is defined at least in part by a first weakened portion 3 and a second portion 5 even more weakened. An arm 6 is mounted for pivotal movement about a pivot point 8 on the frangible area 4 and includes a lower (as shown) foot part 9 extending into the interior of the hollow body 2. The foot part 9 includes an edge 10 substantially aligned with the second portion 5 of the frangible area 4.

In use, when the energy of the fluid contained within the hollow body 2 is to be utilised to dispense a substance e.g. soda water or force particles of a therapeutic agent through the skin of a patient, then a force 'P' is applied at or adjacent the free end of the arm 6 which will pivot about the pivot point 8 thereby causing the edge 10 of the foot part 9 to engage and rupture the frangible area 4 initially at the second weakened portion 5. The pivotal action of the arm 6 together with the pressure of the fluid e.g. helium at between 60 and 80 bar will continue the rupturing process with the frangible area 4 being pivoted around the first weakened portion 3 which acts as a hinge. The fluid will thus be released under pressure from the hollow body 2 of the capsule 1.

Although reference has been made to the use of the capsules with a needle-less syringe for medical purposes, there are a number of other applications where the force of the contained fluid can be utilised. For example, in the inflation of balloons bearing fluorescent markings for identification by radar and for the inflation of life jackets and dinghies.

The energy of the pressurized fluid could also be utilized in a weapon to act as a propellant for a bullet or other projectile.

We claim:

1. A capsule containing helium comprising a hollow body, a frangible area formed on a surface of the hollow body, a cantilever arm and means for fixedly attaching the cantilever arm to the frangible area such that the arm is spaced from and extends outwardly of the hollow body such that a force, when applied at or adjacent the free end of the cantilever arm in the direction towards the hollow body, will, together with the pressure of the helium in the hollow body, cause the frangible area to rupture outwardly with the subsequent release of the helium.

2. A capsule in accordance with claim 1 wherein the helium gas inside the hollow body is at a pressure of at least 60 bar.

3. A capsule in accordance with claim 1, wherein the frangible area has an outer surface and the means for fixedly attaching the cantilever arm to the frangible area is an anchor member located on the outer surface of the frangible area.

4. A capsule in accordance with claim 1, wherein the frangible area is defined at least in part by a first weakened portion and a second portion even more weakened than the first weakened portion.

5. A capsule in accordance with claim 4, wherein the arm is mounted for pivotal movement on the frangible area and includes a foot part located inside the hollow body having an edge for engaging the second portion of the frangible area.

* * * * *